US009964342B2

(12) United States Patent
Kitabatake et al.

(10) Patent No.: US 9,964,342 B2
(45) Date of Patent: May 8, 2018

(54) OUTDOOR UNIT FOR AIR-CONDITIONING APPARATUS

(71) Applicant: Mitsubishi Electric Corporation, Tokyo (JP)

(72) Inventors: Yo Kitabatake, Tokyo (JP); Shigeru Hata, Tokyo (JP); Keiichi Tomita, Tokyo (JP); Yohei Kawaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 156 days.

(21) Appl. No.: 14/937,990

(22) Filed: Nov. 11, 2015

(65) Prior Publication Data

US 2016/0146512 A1 May 26, 2016

(30) Foreign Application Priority Data

Nov. 25, 2014 (JP) ..... 2014-237920

(51) Int. Cl.

| | |
|---|---|
| ***F25D 19/00*** | (2006.01) |
| ***F25B 13/00*** | (2006.01) |
| ***F24F 1/12*** | (2011.01) |
| ***F24F 1/40*** | (2011.01) |
| *F24F 13/24* | (2006.01) |

(52) U.S. Cl.

CPC ..... *F25B 13/00* (2013.01); *F24F 1/12* (2013.01); *F24F 1/40* (2013.01); *F24F 2013/242* (2013.01)

(58) Field of Classification Search

CPC ..... F25B 13/00; F24F 1/12

USPC ..... 62/297, 498, 508

See application file for complete search history.

(56) References Cited

FOREIGN PATENT DOCUMENTS

| | | | |
|---|---|---|---|
| CN | 102549344 | A | 7/2012 |
| EP | 2 042 820 | A2 | 4/2009 |
| JP | 60-096555 | A | 7/1985 |
| JP | H01-172625 | | 12/1989 |
| JP | H09-243115 | A | 9/1997 |
| JP | H11-270881 | A | 10/1999 |
| JP | 2000-205590 | A | 7/2000 |
| JP | 2009-085465 | A | 4/2009 |
| JP | 2013-204840 | A | 10/2013 |
| JP | 2014-047995 | | 3/2014 |
| WO | 2011/052317 | A1 | 5/2011 |

OTHER PUBLICATIONS

Office action dated Mar. 28, 2017 issued in corresponding JP patent application No. 2014-237920. (with English translation).

Extended European Search Report dated May 2, 2016 issued in corresponding EP patent application No. 15196192.7.

Office action dated Jan. 2, 2018 issued in corresponding CN patent application No. 201510833755.4 (and English translation thereof).

*Primary Examiner* — Melvin Jones

(74) *Attorney, Agent, or Firm* — Posz Law Group, PLC

(57) ABSTRACT

An outdoor unit for an air-conditioning apparatus includes a machine chamber in which a compressor serving as a vibration source and at least two refrigerant-circuit components and are provided. One of the refrigerant-circuit components and is provided with an elastic tab while an other refrigerant-circuit component or is provided with a catching portion that is engageable with the elastic tab. The refrigerant-circuit components and are brought into close contact with each other by the elastic tab and the catching portion.

7 Claims, 4 Drawing Sheets

OUTDOOR UNIT FOR AIR-CONDITIONING APPARATUS

TECHNICAL FIELD

The present invention relates to an outdoor unit for an air-conditioning apparatus in which vibrations occurring in a machine chamber that houses a compressor and refrigerant-circuit components are suppressed.

BACKGROUND ART

In a typical outdoor unit for an air-conditioning apparatus, refrigerant compressed by a compressor provided on a bottom plate of a machine chamber circulates through the outdoor unit and undergoes heat exchange in a heat exchanger provided on a bottom plate of an air-sending-device chamber. Note that the bottom plate of the machine chamber and the bottom plate of the air-sending-device chamber are integrated with each other. Therefore, vibrations generated when the compressor is operating are transmitted to the heat exchanger via the bottom plate. As a countermeasure for preventing such vibrations, there is a known technique in which a component having a hook and a component having a hook hole are made to engage with each other, and the heat exchanger is fixed by using these components, whereby the wobbling of the heat exchanger during operation is suppressed (see Patent Literature 1, for example).

There is another known technique in which one of two heat exchangers is provided with an end plate having a tab while the other heat exchanger is provided with an end plate having an opening, and the end plates are made to engage with each other so that the two heat exchangers are fixed to each other, whereby the influence of external forces is reduced (see Patent Literature 2, for example).

CITATION LIST

Patent Literature

[Patent Literature 1] Japanese Unexamined Utility Model Registration Application Publication No. 60-096555 (FIGS. 2 to 4)

[Patent Literature 2] Japanese Unexamined Patent Application Publication No. 2014-047995 (FIGS. 4 and 5)

SUMMARY OF INVENTION

Technical Problem

Each of the above fixing mechanisms employing the hook (or the tab) and the hook hole (or the opening) only suppresses vibrations of the heat exchanger provided in the air-sending-device chamber and does not suppress vibrations occurring in the machine chamber in which the compressor as a vibration source is provided.

Increasing the size of the air-sending-device chamber increases an area of heat exchange and thus improves the performance of the outdoor unit. Hence, it is preferable that, in a limited space of the outdoor unit that is enclosed by an outer shell, the size of the machine chamber be made as small as possible so that the size of the air-sending-device chamber is increased instead. In the known art, interference among refrigerant-circuit components in the machine chamber that may be caused by vibrations of the compressor is prevented by providing some clearance between adjacent ones of the components. Such a known configuration has a problem in that it is inevitable to increase the size of the machine chamber, particularly in the width direction, so that enough clearance is provided. Consequently, it becomes difficult to provide an outdoor unit exhibiting a required level of performance.

Furthermore, a multi-type outdoor unit to which a plurality of indoor units are connectable has many ports for the connection of pipes of the outdoor unit to pipes of the indoor units. Therefore, in addition to the above problem of clearance, another problem arises in that the size of a component connecting pipes between the outdoor unit and an indoor unit having ports is large and such a component is difficult to handle in the work of assembling the outdoor unit.

The present invention is to solve at least one of the above problems and chiefly aims to suppress vibrations in a machine chamber while the size of the machine chamber is reduced.

Solution to Problem

An outdoor unit for an air-conditioning apparatus according to the present invention includes a machine chamber in which a compressor serving as a vibration source and at least two refrigerant-circuit components are provided. One of the refrigerant-circuit components is provided with an elastic tab while an other refrigerant-circuit component is provided with a catching portion that is engageable with the elastic tab. The refrigerant-circuit components are brought into close contact with each other by the elastic tab and the catching portion.

Advantageous Effects of Invention

In the outdoor unit for an air-conditioning apparatus according to the present invention, the refrigerant-circuit components provided in the machine chamber are brought into close contact with each other by the elastic tab and the catching portion. Thus, vibrations of the components are suppressed. Accordingly, the clearance provided in the known art as a countermeasure for interference among components due to vibrations is not necessary. Instead of providing such clearance, the size of the machine chamber can be reduced, and the size of an air-sending-device chamber can be increased. Thus, the heat-exchangeability of the outdoor unit can be improved.

DESCRIPTION OF EMBODIMENTS

Figure 1:
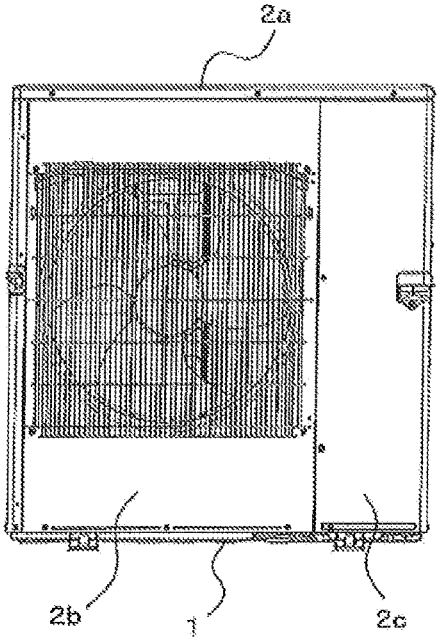
FIG. 1 is a front view of an outdoor unit for an air-conditioning apparatus according to Embodiment of the present invention.
Figure 2:
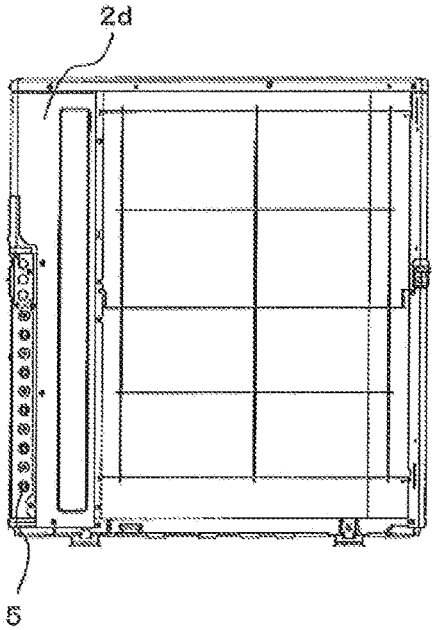
FIG. 2 is a rear view of the outdoor unit illustrated in FIG. 1.
Figure 3:
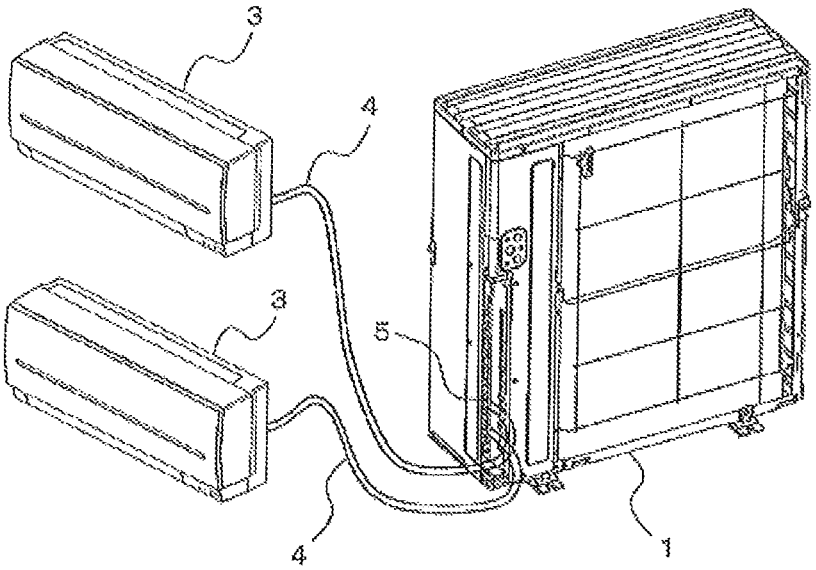
FIG. 3 is a perspective view of the outdoor unit illustrated in FIG. 1 to which a plurality of indoor units are connected.

FIG. 1 is a front view of an outdoor unit for an air-conditioning apparatus according to Embodiment of the present invention, for example, a multi-type outdoor unit to which a plurality of indoor units are connectable. FIG. 2 is a rear view of the outdoor unit illustrated in FIG. 1. FIG. 3 is a perspective view of the outdoor unit illustrated in FIG. 1 to which a plurality of indoor units are connected.

Referring to FIGS. 1 and 2, an outdoor unit 1 for an air-conditioning apparatus according to Embodiment has an outer shell that is formed of design panels 2*a*, 2*b*, 2*c*, and 2*d*, which prevent any rainwater or flames on the outside from entering a machine chamber. Referring to FIGS. 2 and 3, the outdoor unit has on the rear face thereof a refrigerant-circuit component, specifically, a component connecting pipes between the outdoor unit and an indoor unit 5 having a plurality of ports 5*a* with which pipes (not illustrated) of the outdoor unit 1 are connected to pipes 4 of a plurality of indoor units. The pipes are connected at the time of installation of the outdoor unit 1.

Figure 4:
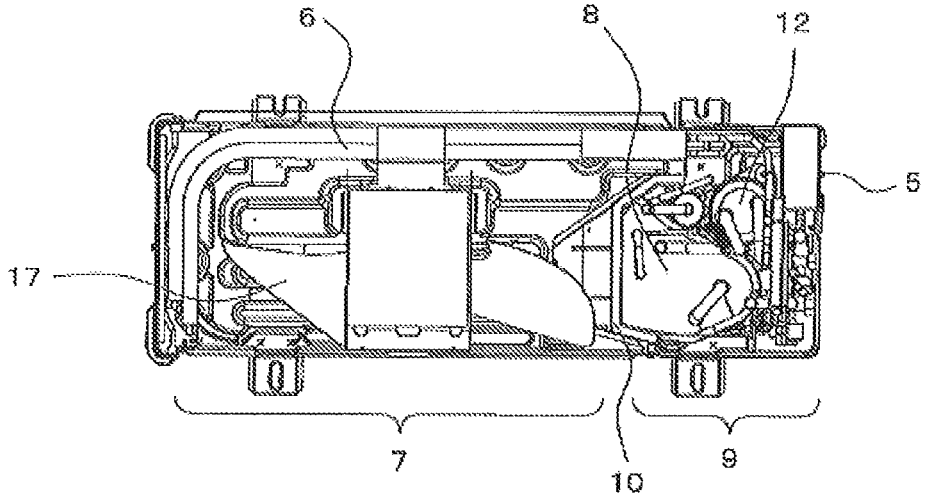
FIG. 4 is a plan view of the outdoor unit illustrated in FIG. 1 with a design panel removed.

FIG. 4 is a plan view of the outdoor unit illustrated in FIG. 1 with one of the design panels removed.

Referring to FIG. 4, the outdoor unit 1 has an air-sending-device chamber 7 in which heat exchange is performed by a heat exchanger 6 and a fan 17, and a machine chamber 9 in which operations such as compression of refrigerant by a compressor 8 are performed. The air-sending-device chamber 7 and the machine chamber 9 are separated from each other by a partition 10.

Figure 5:
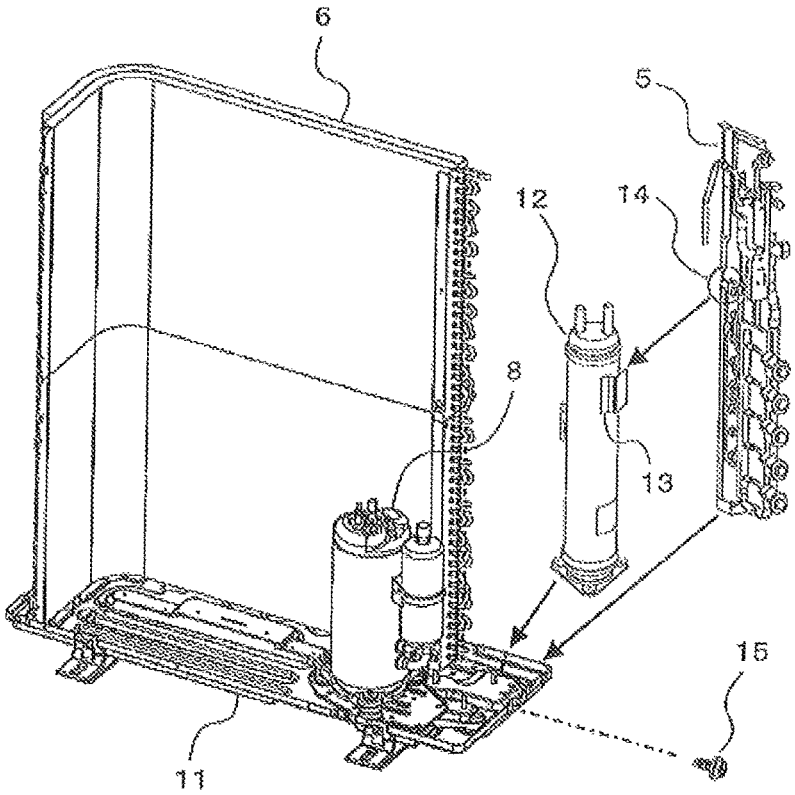
FIG. 5 is an exploded perspective view of the outdoor unit illustrated in FIG. 1 and illustrates featured elements thereof.
Figure 6:
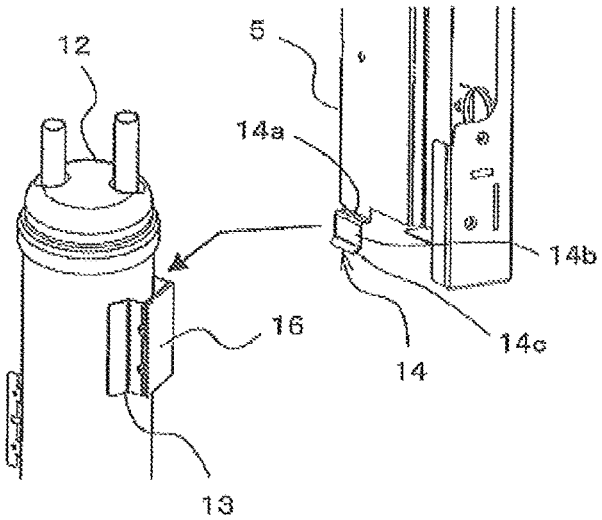
FIG. 6 is an enlarged perspective view of the outdoor unit illustrated in FIG. 1 and illustrates the featured elements including an elastic tab and a catching portion.
Figure 7:
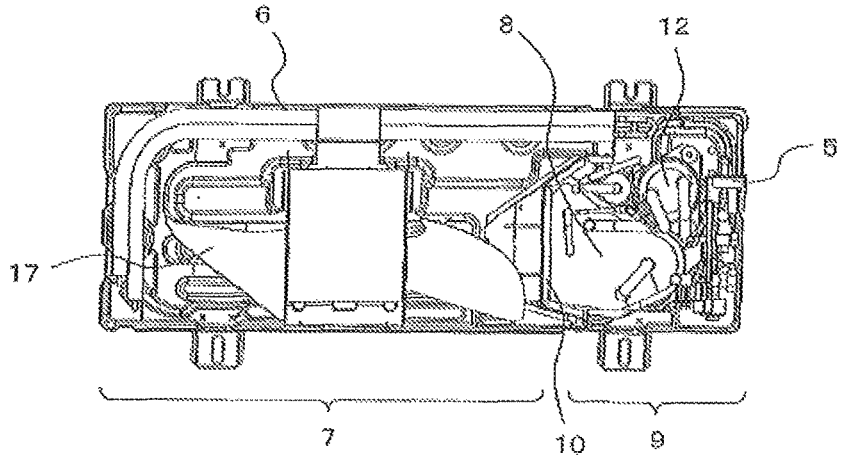
FIG. 7 is a plan view of the outdoor unit illustrated in FIG. 1 and illustrates a state of assembly of a component connecting pipes between the outdoor unit and an indoor unit and an accumulator, which are refrigerant-circuit components.
Figure 8:
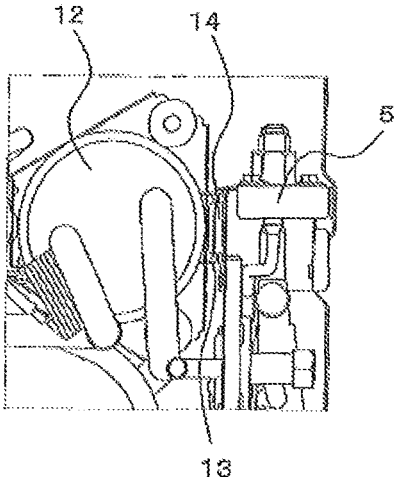
FIG. 8 is an enlarged plan view of the outdoor unit illustrated in FIG. 1 and illustrates the featured elements including the elastic tab and the catching portion that are in engagement with each other.
Figure 9:
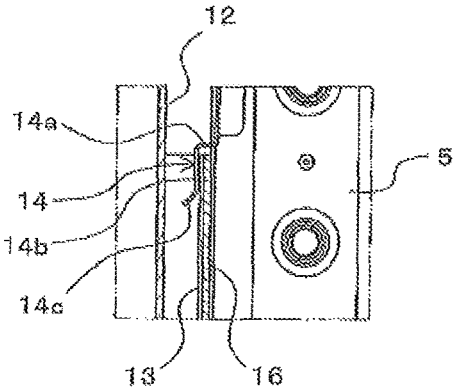
FIG. 9 is an enlarged vertical sectional view of the outdoor unit illustrated in FIG. 1 and illustrates the featured elements including the elastic tab and the catching portion that are in engagement with each other.

FIG. 5 is an exploded perspective view of the outdoor unit illustrated in FIG. 1 and illustrates featured elements thereof. FIG. 6 is an enlarged perspective view of the outdoor unit illustrated in FIG. 1 and illustrates the featured elements including an elastic tab and a catching portion. FIG. 7 is a plan view of the outdoor unit illustrated in FIG. 1 and illustrates a state of assembly of the component connecting pipes between the outdoor unit and an indoor unit and an accumulator, which are refrigerant-circuit components. FIG. 8 is an enlarged plan view of the outdoor unit illustrated in FIG. 1 and illustrates the featured elements including the elastic tab and the catching portion that are in engagement with each other. FIG. 9 is an enlarged vertical sectional view of the outdoor unit illustrated in FIG. 1 and illustrates the featured elements including the elastic tab and the catching portion that are in engagement with each other.

Referring to FIGS. 5 to 9, the outdoor unit 1 includes the heat exchanger 6, the compressor 8, the component connecting pipes between the outdoor unit and an indoor unit 5 as a refrigerant-circuit component, and an accumulator 12 as another refrigerant-circuit component, all of which are attached to a bottom plate 11. Among these elements, the compressor 8, the component connecting pipes between the outdoor unit and an indoor unit 5, and the accumulator 12 are provided in an area on the bottom plate 11 that is defined as the machine chamber 9. The accumulator 12 is connected to a suction-side pipe of the compressor 8 and stores the refrigerant.

To assemble the component connecting pipes between the outdoor unit and an indoor unit 5 and the accumulator 12 together, an elastic tab 14 provided to one of the two (in this case, the component connecting pipes between the outdoor unit and an indoor unit 5) is inserted into a catching portion 13 provided to the other (in this case, the accumulator 12). Thus, the two components are brought into close contact with each other and are temporarily fixed to each other.

More specifically, referring to FIG. 6, the elastic tab 14 includes a base portion 14*a* extending outward, a lock portion 14*b* extending downward from the tip of the base portion 14*a*, and a guide portion 14*c* extending outward from the lower end of the lock portion 14*b* while sloping downward. When the elastic tab 14 is inserted into the catching portion 13, the guide portion 14*c* comes into contact with and slides along an edge of the catching portion 13, whereby the lock portion 14*b* is bent or elastically deforms while storing a restoring force. Thus, the component connecting pipes between the outdoor unit and an indoor unit 5 and the accumulator 12 are urged toward and brought into close contact with each other.

After the elastic tab 14 is thus inserted into the catching portion 13, the component connecting pipes between the outdoor unit and an indoor unit 5 is finally fastened to the bottom plate 11 with a screw 15 as illustrated in FIG. 5.

A surface of the catching portion 13 with which the elastic tab 14 comes into contact is provided with a rubber component 16. The rubber component 16 absorbs the impact of any component that is to come into contact with the catching portion 13.

To summarize, in the outdoor unit for an air-conditioning apparatus according to Embodiment, such as the multi-type outdoor unit 1 to which a plurality of indoor units are connectable, the component connecting pipes between the outdoor unit and an indoor unit 5 and the accumulator 12 that are provided in the machine chamber 9 can be brought into close contact with each other by using the elastic tab 14 and the catching portion 13, whereby vibrations of the component connecting pipes between the outdoor unit and an indoor unit 5 and the accumulator 12 can be suppressed. Therefore, the clearance between adjacent ones of the components that is provided in the known art can be eliminated. Hence, the size of the machine chamber 9 can be reduced. Instead, the size of the air-sending-device chamber 7 can be increased. Thus, the heat-exchangeability of the outdoor unit 1 can be improved.

Furthermore, the rubber component 16 provided on the surface of the catching portion 13 with which the component connecting pipes between the outdoor unit and an indoor unit 5 comes into contact can absorb the impact of any component that is to come into contact with the catching portion 13.

Furthermore, the component connecting pipes between the outdoor unit and an indoor unit 5 and the accumulator 12 are temporarily fixed to each other by using the elastic tab 14 and the catching portion 13 and are finally fastened to the bottom plate 11 of the machine chamber 9 with the screw 15. Since the component connecting pipes between the outdoor unit and an indoor unit 5, which is intended for a multi-type outdoor unit and is of a large size, can be temporarily fixed to the accumulator 12 before being fastened to the bottom plate 11 with the screw 15, the ease of component-attaching work in the process of assembling the outdoor unit 1 is increased.

While Embodiment concerns an exemplary case where the elastic tab 14 is provided to the component connecting pipes between the outdoor unit and an indoor unit 5 and the catching portion 13 that catches the elastic tab 14 is provided to the accumulator 12, the elastic tab 14 may be provided to the accumulator 12 and the catching portion 13 may be provided to the component connecting pipes between the outdoor unit and an indoor unit 5.

Moreover, while Embodiment concerns an exemplary case where the accumulator 12 and the component connecting pipes between the outdoor unit and an indoor unit 5 are taken as refrigerant-circuit components, other exemplary refrigerant-circuit components include a four-way valve, an expansion valve, and so forth. Hence, the present invention is also applicable to the arrangement of the four-way valve and the expansion valve.

REFERENCE SIGNS LIST

1: outdoor unit 2*a*, 2*b*, 2*c*, 2*d*: design panel 3: indoor unit 4: pipe 5: component connecting pipes between the outdoor unit and an indoor unit (refrigerant-circuit component) 5*a*: port 6: heat exchanger 7: air-sending-device chamber 8: compressor 9: machine chamber 10: partition 11: bottom plate 12: accumulator (refrigerant-circuit component) 13: catching portion 14: elastic tab 14*a*: base portion 14*b*: lock portion 14*c*: guide portion 15: screw 16: rubber component 17: fan

The invention claimed is:

1. An outdoor unit for an air-conditioning apparatus, the outdoor unit comprising:

a machine chamber in which a compressor serving as a vibration source and at least two refrigerant-circuit components are provided, wherein one of the refrigerant-circuit components is provided with an elastic tab while an other refrigerant-circuit component is provided with a catching portion that is engageable with the elastic tab, wherein the refrigerant-circuit components are in close contact with each other by the elastic tab and the catching portion, wherein the elastic tab includes a base portion extending outward;

a lock portion extending downward from a tip of the base portion; and a guide portion extending outward from a lower end of the lock portion while sloping downward, and wherein the guide portion is configured to, when the elastic tab is fit in the catching portion, be in contact with and slide along an edge of the catching portion, to cause the lock portion to elastically deform and store a restoring force urging the refrigerant-circuit components toward each other and bring the refrigerant-circuit components into close contact with each other.

2. An outdoor unit for an air-conditioning apparatus, the outdoor unit comprising:

a machine chamber in which a compressor serving as a vibration source and at least two refrigerant-circuit components are provided, wherein one of the refrigerant-circuit components is provided with an elastic tab while an other refrigerant-circuit component is provided with a catching portion that is engageable with the elastic tab, wherein the refrigerant-circuit components are in close contact with each other by the elastic tab and the catching portion, and wherein a surface of the catching portion with which the elastic tab is configured to be in contact is provided with a rubber component.

3. The outdoor unit for an air-conditioning apparatus of claim 1, wherein the refrigerant-circuit components are temporarily fixable to each other by the elastic tab and the catching portion before finally being fastened to a bottom plate of the machine chamber with a screw.

4. The outdoor unit for an air-conditioning apparatus of claim 1, wherein the refrigerant-circuit components are an accumulator and a component connecting pipes between the outdoor unit and an indoor unit.

5. The outdoor unit for an air-conditioning apparatus of claim 2, wherein the refrigerant-circuit components are temporarily fixable to each other by the elastic tab and the catching portion before finally being fastened to a bottom plate of the machine chamber with a screw.

6. The outdoor unit for an air-conditioning apparatus of claim 2, wherein the refrigerant-circuit components are an accumulator and a component connecting pipes between the outdoor unit and an indoor unit.

7. The outdoor unit for an air-conditioning apparatus of claim 1, wherein a surface of the catching portion with which the elastic tab is configured to be in contact is provided with a rubber component.

* * * * *